US011974607B2

(12) United States Patent
Mironov et al.

(10) Patent No.: US 11,974,607 B2
(45) Date of Patent: May 7, 2024

(54) INDUCTIVELY HEATABLE AEROSOL-GENERATING ARTICLE COMPRISING AN AEROSOL-FORMING ROD SEGMENT AND METHOD FOR MANUFACTURING SUCH AEROSOL-FORMING ROD SEGMENTS

(71) Applicant: Philip Morris Products S.A., Neuchatel (CH)

(72) Inventors: Oleg Mironov, Neuchatel (CH); Andreas Michael Rossoll, Neuchatel (CH); Jerome Christian Courbat, Neuchatel (CH); Enrico Stura, Neuchatel (CH); Roberto Mancini, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 627 days.

(21) Appl. No.: 17/263,007

(22) PCT Filed: Jul. 30, 2019

(86) PCT No.: PCT/EP2019/070405
§ 371 (c)(1),
(2) Date: Jan. 25, 2021

(87) PCT Pub. No.: WO2020/025562
PCT Pub. Date: Feb. 6, 2020

(65) Prior Publication Data

US 2021/0161208 A1 Jun. 3, 2021

(30) Foreign Application Priority Data

Jul. 31, 2018 (EP) ..... 18186693

(51) Int. Cl.
*A24F 40/465* (2020.01)
*A24C 5/01* (2020.01)
(Continued)

(52) U.S. Cl.
CPC ..... *A24F 40/465* (2020.01); *A24C 5/01* (2020.01); *A24D 1/20* (2020.01); *A24F 40/20* (2020.01)

(58) Field of Classification Search
CPC ..... A24F 40/465; A24F 40/20; A24C 5/01; A24D 1/20; H05B 6/105
See application file for complete search history.

(56) References Cited

U.S. PATENT DOCUMENTS

2017/0311648 A1 11/2017 Gill et al.
2018/0310607 A1 11/2018 Prestia et al.
(Continued)

FOREIGN PATENT DOCUMENTS

CN 107404948 A 11/2017
CN 107427079 A 12/2017
(Continued)

OTHER PUBLICATIONS

Japanese Office Action dated Jan. 26, 2023 in Japanese Patent Application No. 2021-504499 (with English Translation), 6 pages.
(Continued)

*Primary Examiner* — Jean F Duverne
(74) *Attorney, Agent, or Firm* — Oblon, McClelland, Maier & Neustadt, L.L.P.

(57) ABSTRACT

An inductively heatable aerosol-generating article for an inductively heating aerosol-generating device is provided, the article including: an aerosol-forming rod segment having a cylindrical shape with a constant outer cross-section including an elongate susceptor element and an aerosol-forming substrate surrounding the susceptor element so as to
(Continued)

define the cylindrical shape of the rod segment, the susceptor element including at least one narrower portion at each extreme end of the susceptor element, and the narrower portion at each extreme end including a reduced transverse cross-section as compared to one or more portions of the susceptor element along a length extension of the susceptor element including a maximum transverse cross-section of the susceptor element. A method is also provided for manufacturing inductively heatable aerosol-forming rod segments in a continuous rod-forming process including usage of a continuous susceptor profile having reduced transverse cross-sections at periodically spaced positions along its length extension.

17 Claims, 4 Drawing Sheets

(51) Int. Cl.
*A24D 1/20* (2020.01)
*A24F 40/20* (2020.01)

(56) References Cited

U.S. PATENT DOCUMENTS

| | | | |
|---|---|---|---|
| 2018/0352855 | A1 | 12/2018 | Prestia et al. |
| 2019/0208813 | A1 | 7/2019 | Rojo-Calderon et al. |

FOREIGN PATENT DOCUMENTS

| | | | | | |
|---|---|---|---|---|---|
| CN | 108323823 | A | | 7/2018 | |
| EP | 3 552 500 | A1 | | 10/2019 | |
| EP | 3552500 | A1 | * | 10/2019 | ..... A24C 5/01 |
| JP | 2018-515113 | A | | 6/2018 | |
| JP | 2018-515114 | A | | 6/2018 | |
| JP | 2018-515115 | A | | 6/2018 | |
| RU | 2 132 629 | C1 | | 7/1999 | |
| WO | WO 2015/176898 | A1 | | 11/2015 | |
| WO | WO 2015/177256 | A1 | | 11/2015 | |
| WO | WO 2016/075436 | A1 | | 5/2016 | |
| WO | WO 2016/184928 | A1 | | 11/2016 | |
| WO | WO 2016/184929 | A1 | | 11/2016 | |
| WO | WO 2016/184930 | A1 | | 11/2016 | |
| WO | WO 2017/036954 | A1 | | 3/2017 | |
| WO | WO 2017/068094 | A1 | | 4/2017 | |
| WO | WO 2018/041450 | A1 | | 3/2018 | |
| WO | WO 2018/138072 | A1 | | 8/2018 | |

OTHER PUBLICATIONS

Combined Russian Office Action and Search Report dated Dec. 9, 2022 in Russian Patent Application No. 2021104808 (with English Translation), 19 pages.
European Office Action dated Apr. 28, 2023 in European Patent Application No. 19 742 786.7, 4 pages.
Combined Chinese Office Action and Search Report dated Sep. 20, 2023 in Chinese Patent Application No. 201980050316.2 (with English Translation), 12 pages.
International Search Report and Written Opinion dated Nov. 5, 2019 in PCT/EP2019/070405 filed on Jul. 30, 2019.

* cited by examiner

INDUCTIVELY HEATABLE AEROSOL-GENERATING ARTICLE COMPRISING AN AEROSOL-FORMING ROD SEGMENT AND METHOD FOR MANUFACTURING SUCH AEROSOL-FORMING ROD SEGMENTS

The present invention relates to an inductively heatable aerosol-generating article comprising an aerosol-forming rod segment as well as to a method for manufacturing such aerosol-forming rod segments.

Aerosol-generating articles including an aerosol-forming substrate capable to form an inhalable aerosol upon heating are generally known. For heating the substrate, the article may be received within an aerosol-generating device comprising an electrical heater. The heater may be an inductive heater comprising an induction source. The induction source is configured for generating an alternating electromagnetic field that induces at least one of heat generating eddy currents or hysteresis losses in a susceptor element. The susceptor element itself may be integral part of the article and arranged such as to be in thermal proximity or direct physical contact with the substrate to be heated. In particular, the article may comprise—among other elements—an aerosol-forming rod segment having a cylindrical shape with a constant cross-section. Within the rod segment, the aerosol-forming substrate surrounds the susceptor element such as to define the cylindrical shape of the segment. Such rod segments may be manufactured in a continuous rod-forming process, in which a continuous susceptor profile and a substrate web comprising the aerosol-forming substrate are positioned relative to each other. Subsequently, the substrate web is gathered around the susceptor profile such as to form a continuous rod-shaped strand which finally is cut into individual aerosol-forming rod segments having a specific length.

It has been observed that the position of the susceptor element within the aerosol-forming substrate may deviate from its desired position, for example, twisted or displaced from a central position of the susceptor element with regard to a center axis of the aerosol-forming rod segment. Such deviations may be due to mechanical influences during the manufacturing of the rod segments causing the susceptor element to drift away from its desired position within the aerosol-forming substrate. In particular during cutting of the continuous rod-shaped strand into individual aerosol-forming rod segments as described above, the susceptor profile may experience forces applied by cuttings means which may have an adverse influence on the positional accuracy. Besides that, the susceptor element may still drift within the aerosol-forming substrate even after the manufacturing processes. Moreover, positioning of the continuous susceptor profile relative to the substrate web sometimes is a cumbersome task due to the mechanical stiffness of the susceptor profile. It has been also observed that particles may be ablated from cutting means and/or from the susceptor during the cutting process and disadvantageously migrate into the aerosol-forming substrate. In addition, it has been observed that some elements of the aerosol-generating article which are in thermal proximity or thermal contact with the susceptor may be adversely affected by overheating, in particular charring.

Yet, positional accuracy and stability of the susceptor element within the rod segment is crucial to ensure adequate heating of the substrate and thus to ensure sufficient product consistency.

Therefore, it would be desirable to have inductively heatable aerosol-generating articles comprising an aerosol-forming rod with a susceptor element as well as a method for manufacturing such rod segments solving at least one of the above mentioned problems of prior art solutions. In particular, it would be desirable to have inductively heatable aerosol-generating articles comprising an aerosol-forming rod segment with a susceptor element and a method for manufacturing such rod segments providing improved positional accuracy and stability of the susceptor.

According to the invention there is provided an inductively heatable aerosol-generating article for use with an inductively heating aerosol-generating device. The article comprises an aerosol-forming rod segment, preferably having a cylindrical shape with a constant cross-section, in particular a constant outer cross-section defining the cylindrical shape. The aerosol-forming rod segment includes an elongate susceptor element and an aerosol-forming substrate surrounding the susceptor element. Preferably, the aerosol-forming substrate surrounds the susceptor element such as to define, that is, to form or fill out, in particular completely fill out the cylindrical shape of the rod segment. The susceptor element comprises at least one narrower portion along the length extension of the susceptor element, in particular at least one narrower portion at each extreme end of the susceptor element and/or at least one narrower portion between both extreme ends of the susceptor element. The respective narrower portion comprises a reduced transverse cross-section as compared to other portions along the length extension of the susceptor element, in particular as compared to one or more portions of the susceptor element along the length extension of the susceptor comprising a maximum transverse cross-section of the susceptor element. Accordingly, a transverse cross-section of the elongate susceptor element along its length extension is reduced, that is, smaller as compared to a transverse cross-section, in particular maximum transverse cross-section of the elongate susceptor element at one or more other positions along its length extension. Preferably, a transverse cross-section of the elongate susceptor element at least at a respective position at each extreme end of the susceptor element and/or at least at a position between two extreme ends of the susceptor element is reduced, that is, smaller as compared to a transverse cross-section, in particular maximum transverse cross-section of the elongate susceptor element at one or more other positions along its length extension.

These one of more narrower portions of reduced transverse cross-section may form recesses which are filled with aerosol-forming substrate during manufacturing of the rod segment. Advantageously, this provides a better fixation of the susceptor element within the aerosol-forming substrate both, in a direction along a center axis of the rod segment as well as in a direction transverse to the center axis of the rod segment. As a consequence, the positional accuracy and stability of the susceptor profile within the aerosol-forming substrate is significantly improved.

Furthermore, a susceptor element comprising one or more portions with a reduced transverse cross-section exhibits a reduced mechanical stiffness as compared to susceptor elements having a constant transverse cross-section. Advantageously, less mechanical stiffness facilitates positioning of the susceptor relative to the aerosol-forming substrate during manufacturing of the aerosol-forming rod. As a result, positional accuracy of the susceptor in the substrate is further improved.

Moreover, when using a susceptor element comprising one or more portions with a reduced transverse cross-section, a smaller portion of the susceptor element is in thermal proximity or thermal contact with elements of the aerosol-generating article that should be prevented from overheating, in particular charring. This may be for example a PLA foil (polylactic acid) used in an aerosol-cooling element of an aerosol-generating article.

As used herein, the terms 'narrower portion' and 'reduced transverse cross-section' are to be understood as a reduction of the dimension of the transverse cross-sectional profile of the susceptor element at least in one direction transverse, in particular perpendicular to a length extension of the elongate susceptor element. In particular, the 'reduced transverse cross-section' comprises a reduced a cross-sectional area of the at least one narrower portion.

The one or more portions of the susceptor element comprising the maximum transverse cross-section of the susceptor element may extend over most of the length extension of the susceptor element. In particular, The one or more portions of the susceptor element comprising the maximum transverse cross-section of the susceptor element may cover at least 70%, in particular at least 75%, preferably at least 80%, most preferably at least 85% or at least 90% of the length extension of the susceptor element. Of course, the one or more portions of the susceptor element comprising the maximum transverse cross-section of the susceptor element may cover less than 75%, in particular at least 15% or at least 20% or at least 25% or at least 50% of the length extension of the susceptor element.

Likewise, the at least one narrower portion may cover at most 30%, in particular at most 25%, preferably at most 20%, most preferably at most 15% or at most 10% of the length extension of the susceptor element. Of course, the at least one narrower portion may cover more than 30%, in particular at most 85% or at most 80% or at most 75% or at most 50% of the length extension of the susceptor element.

Advantageously, a cross-sectional area of the at least one narrower portion is at most 90%, in particular at most 85% or at most 80% or at most 75% or at most 70% or at most 65% or at most 60% or at most 55% or at most 50% or at most 45% or at most 40% or at most 35% or at most 30% or at most 25% or at most 20%, preferably at most 15% or at most 10% of a cross-sectional area of the maximum transverse cross-section, in particular over at least 1%, preferably over at least 2% or at least 5% or at least 10% or at least 15% or at least 20% or at least 25% or at least 30% or at least 35% or at least 40% or at least 45% or at least 50% or at least 55% or at least 60% or at least 65% or at least 70% or at least 75% or at least 80% of the length extension of the elongate susceptor element. Any of the afore-mentioned relative values of the cross-sectional area of the at least one narrower portion may be combined with any of the afore-mentioned relative values of the length extension of the at least one narrower portion along the length extension of the elongate susceptor element.

For example, a cross-sectional area of the at least one narrower portion is at most 50%, in particular at most 30%, preferably at most 15% of a cross-sectional area of the maximum transverse cross-section over at least 1% of the length extension of the elongate susceptor element.

Likewise, a cross-sectional area of the at least one narrower portion is at most 90%, in particular at most 75%, preferably at most 50% of a cross-sectional area of the maximum transverse cross-section over at least 5% of the length extension of the elongate susceptor element.

Alternatively, a cross-sectional area of the at least one narrower portion is at most 80%, in particular at most 75%, preferably at most 50% of a cross-sectional area of the maximum transverse cross-section over at least 80% of the length extension of the elongate susceptor element the reduced transverse cross-section of the at least one narrower portion.

A cross-sectional area of the maximum transverse cross-section is in a range of 0.1 $mm^2$ (square millimeter) to 5.0 $mm^2$ (square millimeter), in particular 0.15 $mm^2$ (square millimeter) to 3 $mm^2$ (square millimeter), preferably 0.2 $mm^2$ (square millimeter) to 1.0 $mm^2$ (square millimeter), most preferably 0.2 $mm^2$ (square millimeter) to 0.5 $mm^2$ (square millimeter).

Preferably, a minimum cross-sectional dimension of the at least one narrower portion is at most 90%, in particular at most 85% or at most 80% or at most 75% or at most 70% or at most 65% or at most 60% or at most 55% or at most 50% or at most 45% or at most 40% or at most 35% or at most 30% or at most 25% or at most 20%, preferably at most 15% or at most 10% of a maximum cross-sectional dimension of the elongate susceptor element in the other portions. As to this, the maximum cross-sectional dimension is measured in the same direction as the minimum cross-sectional dimension transverse to a length extension of the elongate susceptor element. That is, a minimum dimension of the reduced transverse cross-section of the susceptor element is at most 75%, in particular at most 50%, preferably at most 30% of a maximum dimension of the transverse cross-section of the elongate susceptor element at the other positions along the length extension of the susceptor element, wherein the maximum dimension of the non-reduced cross-section at the other positions is measured in the same direction as the minimum dimension of the reduced transverse cross-section transverse, in particular perpendicular to a length extension of the elongate susceptor. Preferably, the minimum dimension and the maximum dimension are measured in a direction along a depth extension of a recess formed by the narrower portions of the susceptor element having the reduced transverse cross-section.

A minimum cross-sectional dimension of the at least one narrower portion may be in a range between 55% and 90%, in particular between 60% and 90%, preferably between 70% and 90%, even more preferably between 75% and 90% of a maximum cross-sectional dimension of the elongate susceptor element in the one or more portions comprising the maximum transverse cross-section, wherein the maximum cross-sectional dimension is measured in the same direction as the minimum dimension cross-sectional transverse to a length extension of the elongate susceptor element.

As mentioned above, the one of more narrower portions of reduced transverse cross-section may form one or more lateral recesses, or vice versa, may be formed by one or more lateral recesses.

Accordingly, the susceptor element may comprise at least one lateral recess in the at least one narrower portion at each extreme end of the susceptor element and/or in the at least one narrower portion between both extreme ends of the susceptor element. That is, the susceptor element may comprise at least one lateral recess at least at a position between both extreme ends and/or at least one lateral recess at a respective position at each extreme end of the susceptor element. Advantageously, these one or more lateral recesses comprises edges facing in directions parallel and/or transverse, in particular perpendicular to the length extension of the elongate susceptor element. Due to these edges the susceptor element and the substrate which fills the recesses interlock, thus, causing the susceptor element being fixed in the surrounding aerosol-forming substrate.

At this point it is worth noting that the at least one narrower portion or recess arranged between both extreme ends of the susceptor element advantageously comprises at least two edges facing in opposite directions parallel to the length extension of the elongate susceptor element. Likewise, the at least one narrower portion or recess at one extreme end advantageously comprises at least one edge facing in a direction along the length extension that is opposite to a direction in which at least one edge of the at least one narrower portion or recess at the other extreme end faces. Due to these opposed edges the susceptor element advantageously is fixed in both directions parallel to its length extension.

Preferably, the at least one narrower portion shows some symmetry which proves advantageous with regard to a symmetric fixation of the susceptor element in the aerosol-forming substrate. Accordingly, the susceptor element may comprise at least two lateral recesses at opposing lateral sides of the elongate susceptor element in the at least one narrower portion between both extreme ends of the susceptor element. Additionally or alternatively, the susceptor element may comprise at least two lateral recesses at opposing lateral sides of the elongate susceptor element at at least one of both extreme ends of the susceptor element, that is, in at least one of the narrower portions at the extreme ends of the susceptor element. Preferably, the susceptor element comprises at least two lateral recesses at opposing lateral sides of the elongate susceptor element at each extreme end, that is, in the respective narrower portions at each extreme end.

Likewise, the at least one lateral recess may fully extend around the circumference of the elongate susceptor element transverse to its length extension. This also proves advantageous with regard to a symmetric fixation of the susceptor element. For example, the at least one lateral recess may be a groove or notch extending fully around the circumference of the susceptor element transverse to its length extension A shape of the at least one lateral recess—as seen in a longitudinal cross-section through the susceptor element along its length extension—is one of: at least partially trapezoidal, at least partially triangular, at least partially wedged, curved, at least partially circular, in particular semi-circular, at least partially oval, in particular semi-oval, at least partially rectangular or polygonal. For example, the shape of one lateral recess—as seen in a longitudinal cross-section through the susceptor element along its length extension—may be a section of a circle, in particular a semi-circle, or a section of an oval, in particular a semi-oval or a triangle or a rectangle or a quadrate or a section of a trapeze or a trapeze.

The shape of the at least one lateral recess may also correspond to a combination of at least two of the aforementioned shapes. For example, the shape of one lateral recess—as seen in a longitudinal cross-section through the susceptor element along its length extension—may be a combination of a section of a circle and a rectangular.

In general, the elongate susceptor may have any shape. For example, the susceptor element may be a susceptor strip, wherein a width of the susceptor strip is larger than a thickness of the susceptor strip. Preferably, the length of the susceptor strip substantially corresponds to a length of the aerosol-forming rod segment. A length of the susceptor strip may be, for example, in a range of 8 millimeter to 16 millimeter, in particular, 10 millimeter to 14 millimeter, preferably 12 millimeter. A width of the susceptor strip in the one or more portions other than the at least one narrower portion may be, for example, in a range of 2 millimeter to 6 millimeter, in particular, 4 millimeter to 5 millimeter. A thickness of the susceptor strip in the one or more portions other than the at least one narrower portion preferably is in a range of 0.03 millimeter to 0.15 millimeter, more preferably 0.05 millimeter to 0.09 millimeter. Strip-like susceptor elements prove advantageous as they can be easily manufactured at low costs. Preferably, the susceptor strip has one of a rectangular or oval cross-sectional profile in the one or more portions other than the at least one narrower portion at each extreme end of the susceptor element and/or than the at least one narrower portion between both extreme ends of the susceptor element.

Alternatively, the susceptor element may be a susceptor rod. A rod-shaped susceptor element advantageously allows for symmetric heating of the surrounding aerosol-forming substrate. Preferably, the susceptor rod has one of a rectangular, quadratic, oval, circular, triangular, star-shaped or polygonal cross-sectional profile in the portions other than the at least one narrower portion at each extreme end of the susceptor element and/or between both extreme ends of the susceptor element. Likewise the susceptor rod have a cross-sectional profile that has the form of the roman letters "T", "X", "U", "C" or "I" (with or without serif). In case of a circular cross-section, the susceptor rod preferably has a width or diameter in a range of 1 millimeter to 5 millimeter.

Preferably, the length of the susceptor element substantially corresponds to a length of the aerosol-forming rod segment. The length of the susceptor element may be, for example, in a range of 8 millimeter to 16 millimeter, in particular, 10 millimeter to 14 millimeter, preferably 12 millimeter. Moreover, the susceptor element is surrounded by the aerosol-forming substrate along its entire length extension. In particular, the aerosol-forming substrate surrounds the susceptor element such as to define the cylindrical shape of the rod segment. That is, the aerosol-forming substrate may completely fill the volume of the cylindrical rod segment, apart from the volume occupied by the susceptor element.

The article may further comprise different elements, in addition to the aerosol-forming rod segment: a support element having a central air passage, an aerosol-cooling element, and a filter element. The filter element preferably serves as a mouthpiece. As used herein, the term 'mouthpiece' means a portion of the article that is placed into a user's mouth in order to directly inhale an aerosol from the article. a user of the aerosol-generating article may puff on. Any one or any combination of these elements may be arranged sequentially to the aerosol-forming rod segment. Preferably, the aerosol-forming rod is arranged at a distal end of the article. Likewise, the filter element preferably is arranged at a proximal end of the article. Furthermore, these elements may have the same outer cross-section as the aerosol-forming rod segment.

The article may further comprise a wrapper surrounding at least a portion the different segments and elements mentioned above such as to keep them together and to maintain the desired cross-sectional shape of the article. Preferably, the wrapper forms at least a portion of the outer surface of the article. For example, the wrapper may be a paper wrapper, in particular a paper wrapper made of cigarette paper. Alternatively, the wrapper may be a foil, for example made of plastics. The wrapper may be fluid permeable such as to allow vaporized aerosol-forming substrate to be released from the article, or to allow air to be drawn into the article through its circumference. Furthermore, the wrapper may comprise at least one volatile substance to be activated and released from the wrapper upon heating. For example, the wrapper may be impregnated with a flavoring volatile substance.

Preferably, the inductively heatable aerosol-generating article according to present invention has a circular or elliptical or oval cross-section. However, the article may also have a square or rectangular or triangular or polygonal cross-section.

In particular with regard to transverse cross-sections of the susceptor element which comprises a well-defined width and/or thickness, in particular rectangular, quadratic, oval or circular transverse cross-sections, the present invention provides an inductively heatable aerosol-generating article for use with an inductively heating aerosol-generating device. The article comprises an aerosol-forming rod segment, preferably having a cylindrical shape with a constant cross-section, in particular a constant outer cross-section defining the cylindrical shape. The aerosol-forming rod segment includes an elongate susceptor element, in particular a susceptor strip or a susceptor rod, and an aerosol-forming substrate surrounding the susceptor element. Preferably, the aerosol-forming substrate surrounds the susceptor element such as to define, that is, to form or fill out, in particular completely fill out the cylindrical shape of the rod segment. The susceptor element comprises at least one narrower portion along the length extension of the susceptor element, in particular at least one narrower portion at each extreme end of the susceptor element and/or at least one narrower portion between both extreme ends of the susceptor element. The respective narrower portion comprises a reduced width and/or a reduced thickness as compared to other portions along the length extension of the susceptor element, in particular as compared to one or more portions of the susceptor element along the length extension of the susceptor comprising a maximum transverse cross-section of the susceptor element.

All features and advantages described above with regard to aerosol-generating article comprising a susceptor element which has at least one narrow portion with a reduced cross-section also apply to the afore-mentioned aerosol-generating article comprising a susceptor element which has at least one narrow portion with a reduced width and/or thickness. Therefore, these features and advantages will not be repeated.

The present invention further relates to an aerosol-generating system comprising an inductively heatable aerosol-generating article according to the invention and as described herein. The system further comprises an inductively heating aerosol-generating device for use with the article. The aerosol-generating device comprises a receiving cavity for receiving the article at least partially therein. The aerosol-generating device further comprise an induction source including an indication coil for generating an alternating, in particular high-frequency electromagnetic field within the receiving cavity such as to inductively heat the susceptor element of the article when the article is received in the receiving cavity.

The device may further comprise a power supply and a controller for powering and controlling the heating process. As referred to herein, the alternating, in particular high-frequency electromagnetic field may be in the range between 500 kHz to 30 MHz, in particular between 5 MHz to 15 MHz, preferably between 5 MHz and 10 MHz.

The aerosol-generating device may be, for example a device as described in WO 2015/177256 A1.

In use, the aerosol-generating article engages with the aerosol-generating device such that the susceptor assembly is located within the fluctuating electromagnetic field generated by the inductor.

Further features and advantages of the aerosol-generating system according to the present invention have been described with regard to aerosol-generating article and will not be repeated.

According to the invention there is also provided a method for manufacturing an inductively heatable aerosol-generating article. The method comprises the steps of:

- providing a rod segment including an aerosol-forming substrate, the rod segment having a cylindrical shape with a constant cross-section;
- providing susceptor element according to the invention and as described herein;
- positioning the susceptor element in the rod segment, in particular in the aerosol-forming substrate Preferably, the step of positioning the susceptor element in the rod segment comprises moving the susceptor element and rod segment relative to each other, thereby pushing the susceptor element into the aerosol-forming substrate included in the rod segment.

Further features and advantages of this method for manufacturing an inductively heatable aerosol-generating article have been described with regard to the aerosol-generating article according to the present invention and will not be repeated.

The present invention further relates to method for manufacturing inductively heatable aerosol-forming rod segments in a continuous rod-forming process. The method comprising the steps of:

- providing a continuous susceptor profile comprising narrower portions having a reduced transverse cross-section at periodically spaced positions along its length extension;
- providing a substrate web comprising an aerosol-forming substrate;
- positioning the susceptor profile and the substrate web relative to each other;
- gathering the substrate web around the susceptor profile such as to form a continuous rod-shaped strand having a cylindrical shape with a constant cross-section;
- cutting the continuous rod-shaped strand into individual aerosol-forming rod segments having a length equal or larger than a period length between the periodically spaced narrower portions.

The method according to the present invention provides a plurality of benefits which partially have already been described above with regard to the aerosol-generating article. First, using a susceptor profile comprising periodically spaced narrower portions with a reduced transverse cross-section facilitates positioning of the susceptor relative to the aerosol-forming substrate prior to gathering the substrate around the susceptor. This is due to the reduced mechanical stiffness of the susceptor profile resulting from the periodically spaced narrower portions. Second, cutting the continuous rod-shaped strand into individual aerosol-forming rod segments having a length equal or larger than a period length between the periodically spaced narrower portions ensures that the each rod segment includes a susceptor element (resulting from cutting the continuous profile) which comprises at least one narrower portion with a reduced transverse cross-section. As described further above with regard to the aerosol-generating article of the present invention, this at least one narrower portion allows for a better fixation of the susceptor element within the aerosol-forming substrate in a direction along a center axis of the aerosol-forming rod segment as well as in a direction transverse to the center axis of the aerosol-forming rod segment. Both, the improved capability of positioning as well as the improved fixation of the susceptor element significantly improves the positional accuracy and stability of the susceptor within the aerosol-forming substrate, and thus helps to ensure sufficient product consistency.

Moreover, usage of a susceptor profile comprising periodically spaced narrower portions along its length extension allows for manufacturing of inductively heatable aerosol-generating articles in which only a reduced portion of the susceptor element (resulting from cutting the continuous profile) is in thermal proximity or thermal contact with other elements of the aerosol-generating article which should be prevented from overheating.

The steps of providing the continuous susceptor profile and the substrate web, positioning the susceptor profile and the substrate web relative to each other, gathering the substrate web around the susceptor profile and cutting the continuous rod-shaped strand into individual aerosol-forming rod segments may be realized in principle in different ways, in particular by using one of the methods and/or apparatus described in WO 2016/184928 A1 or WO 2016/184929 A1.

According to one aspect of the method, the step of providing a continuous susceptor profile comprising narrower portions having a reduced transverse cross-section at periodically spaced positions along its length extension comprises the steps of:

- providing a continuous susceptor profile with constant cross-section;
- introducing lateral recesses into the susceptor at the periodically spaced positions along its length extension such as to generate the continuous susceptor profile comprising the periodically spaced narrower portions.

Preferably, the step of introducing lateral recesses into the susceptor takes place prior to positioning the susceptor profile and the substrate web relative to each other. Advantageously, this allows for cleaning the susceptor from particles that possibly may be ablated from the susceptor material during introducing the lateral recesses into the susceptor. Thus, the risk of subsequent particle migration into the aerosol-forming substrate may be reduced.

The step of introducing lateral recesses into the susceptor may be part of the overall continuous rod-forming process. In particular, the lateral recesses may be introduced into the susceptor profile while the latter is supplied to the steps of relative positioning and gathering of the substrate web around the susceptor profile.

Advantageously, the step of introducing lateral recesses into the susceptor profile may include using a cutting device. The cutting device may, for example, comprise at least one of a cutting knife, opposing rollers with cutting knives, a shear, a mil, or a punch.

Alternatively, the periodically spaced narrower portions may be generated prior to providing the susceptor profile to the continuous rod-forming process.

According to another aspect of the method, the step of cutting the continuous rod-shaped strand may comprise cutting the continuous rod-shaped strand at the positions of the narrower portions such as to form individual aerosol-forming rod segments having a length corresponding to the period length between the periodically spaced narrower portions.

According to this aspect of the method, it has be recognized that during cutting of the continuous rod-shaped strand the relative angular orientation of the susceptor profile within the rod-shaped strand is undefined such that the cutting angle between the susceptor strip and a cutting device used for the cutting process is undefined as well. Disadvantageously, this may impair the cutting quality and also cause some variance in the susceptor position within the final rod segment. The present invention achieves a significant improvement of this situation by locally reducing the cross-section of the susceptor profile at periodically spaced positions along its length extension. Advantageously, this allows for cutting the continuous rod-shaped strand at well-defined thinned locations. Though the angular position of the susceptor profile is still undefined, cutting of the susceptor profile at the narrower portions is much less challenging. As to this, the narrower portions may be considered as narrow weakened ligaments between portions of unreduced cross-section which may be readily cut through. Thus, the mechanical forces applied during cutting may be significantly reduced which in turn causes the specific angular position of the susceptor profile to be less crucial. As a result, the positional accuracy and stability of the susceptor within the final rod-segment is further improved.

Furthermore, cutting the susceptor profile at the weakened ligaments between portions of unreduced cross-section advantageously increases the lifetime of the cutting means used for this process step.

Moreover, cutting at the weakened narrower portions and applying less mechanical forces during cutting advantageously reduces the risk of particle migration into the aerosol-forming substrate. Such particle migration may be caused by particle ablation from the susceptor and/or the cutting means during the cutting process.

To ensure that the continuous rod-shaped strand is cut into individual rod segments at the desired positions of the narrower portions, the method may further comprise the steps of:

- tracing the trajectory of the susceptor profile when passing through the continuous rod-forming process;
- determining—based on the traced trajectory of the susceptor profile and the period length between the periodically spaced positions of the reduced transverse cross-sections—a point in time when a respective narrower portion of the susceptor profile arrives at a cutting position along the continuous rod-forming process where the step of cutting the continuous rod-shaped strand into individual aerosol-forming rod segments takes place; and
- triggering the step of cutting the continuous rod-shaped strand at the point in time determined for the respective narrower portion.

Advantageously, tracing the trajectory of the susceptor profile may be accomplished by a controller. The controller may be capable to determine the velocity of the susceptor profile through the continuous rod-forming process, a point in time when a respective narrower portion of the susceptor profile passes at a specific control position along the continuous rod-forming process. Preferably, the control position is upstream the step of positioning the susceptor profile and the substrate web relative to each other. The point in time when a respective narrower portion of the susceptor profile arrives at the cutting position may be determined from the velocity of the susceptor profile, the point in time of passing the control position, and the pre-determined distance between the control position and the cutting position. The controller may comprise a sensor, in particular an optical sensor, such as a camera, to determine the point in time of passing the control position. The controller may be a controller used for controlling the overall continuous rod-forming process.

According to a further aspect of the method, the method may comprise the step of crimping the substrate web prior to positioning the susceptor profile and the substrate web relative to each other. In particular, the substrate web may be crimped longitudinally. That is, the substrate web may be provided with a longitudinal folding structure along a longitudinal axis of the continuous sheet, that is, along a transport direction of the substrate web. Preferably, the longitudinal folding structure provides the substrate with a zigzag or wave-like cross section. Advantageously, crimping the substrate web facilitates the step of gathering the substrate web in a transverse direction with respect to its longitudinal axis into the final rod shape. In particular, the longitudinal folding structure supports proper folding of the aerosol-forming substrate around the susceptor. This proves advantageous for manufacturing aerosol-forming rods with reproducible specifications. Even more, crimping the substrate web facilitates advantageously facilitates accurate positioning of a susceptor profile having periodically spaced narrower portions in the substrate web. As a result, the positional accuracy and stability of the susceptor profile within the aerosol-forming substrate is significantly improved.

The aerosol-forming rod segments may be used to form an inductively heatable aerosol-generating article, in particular an aerosol-generating article according to the invention and as described herein. In particular, the article may further comprise—in addition to the aerosol-forming rod—at least one of a support element, an aerosol-cooling element, and a filter element. Any one or any combination of these elements may be arranged sequentially to the aerosol-forming rod segment. These elements may have the same outer cross-section as the aerosol-forming rod segment. In particular, the aerosol-forming rod segment and any one or any combination of the above elements may be arranged sequentially and circumscribed by an outer wrapper to form a rod-shaped article.

Further features and advantages of the method for manufacturing inductively heatable aerosol-forming rod segments have been described above with regard to the aerosol-generating article according to the present invention and will not be repeated.

In general and with regard to all aspects of the present invention, the term 'aerosol-generating article'—as used herein—refers to an article comprising an aerosol-forming substrate to be used with an aerosol-generating device. The aerosol-generating article may be a consumable, in particular a consumable to be discarded after a single use. The aerosol-generating article may be a tobacco article. In particular, the article may be a rod-shaped article resembling conventional cigarettes.

As used herein, the terms 'susceptor element' and 'susceptor profile' refer to an element or profile comprising a material that is capable of being inductively heated within an alternating electromagnetic field. This may be the result of at least one of hysteresis losses or eddy currents induced in the susceptor, depending on the electrical and magnetic properties of the susceptor material. Hysteresis losses occur in ferromagnetic or ferrimagnetic susceptors due to magnetic domains within the material being switched under the influence of an alternating electromagnetic field. Eddy currents may be induced if the susceptor is electrically conductive. In case of an electrically conductive ferromagnetic susceptor or an electrically conductive ferrimagnetic susceptor, heat can be generated due to both, eddy currents and hysteresis losses.

The susceptor element or profile may be formed from any material that can be inductively heated to a temperature sufficient to generate an aerosol from the aerosol-forming substrate. Preferred susceptor profiles comprise a metal or carbon. A preferred susceptor profile may comprise or consist of a ferromagnetic material, for example a ferromagnetic alloy, ferritic iron, or a ferromagnetic steel or stainless steel. Another suitable susceptor profile may be, or comprise, aluminum. Preferred susceptor profiles may be heated to a temperature in excess of 250 degrees Celsius. The susceptor profile may also comprise a non-metallic core with a metal layer disposed on the non-metallic core, for example metallic tracks formed on a surface of a ceramic core. According to another example, the susceptor profile may have a protective external layer, for example a protective ceramic layer or protective glass layer encapsulating the susceptor profile. The susceptor may comprise a protective coating formed by a glass, a ceramic, or an inert metal, formed over a core of susceptor material.

The susceptor profile may be a multi-material susceptor. In particular, the susceptor profile may comprise a first susceptor material and a second susceptor material. The first susceptor material preferably is optimized with regard to heat loss and thus heating efficiency. For example, the first susceptor material may be aluminum, or a ferrous material such as a stainless steel. In contrast, the second susceptor material preferably is used as temperature marker. For this, the second susceptor material is chosen such as to have a Curie temperature corresponding to a predefined heating temperature of the susceptor assembly. At its Curie temperature, the magnetic properties of the second susceptor change from ferromagnetic to paramagnetic, accompanied by a temporary change of its electrical resistance. Thus, by monitoring a corresponding change of the electrical current absorbed by the induction source it can be detected when the second susceptor material has reached its Curie temperature and, thus, when the predefined heating temperature has been reached. The second susceptor material preferably has a Curie temperature that is below the ignition point of the aerosol-forming substrate, that is, preferably lower than 500 degrees Celsius. Suitable materials for the second susceptor material may include nickel and certain nickel alloys.

Preferably, the susceptor profile is dimensionally stable. For this, the shape and material of the susceptor profile may be chosen such as to ensure sufficient dimensional stability. Advantageously, this assures that the originally desired heating susceptor profile is preserved throughout the rod-forming process which in turn reduces the variability of the product performance. Accordingly, the step of gathering the substrate web around the susceptor profile is performed such that the susceptor profile substantially remains undeformed after passing through the rod-forming process. This means, that preferably, any deformation of the susceptor profile remains elastic such that the susceptor profile returns to its intended shape when a deforming force is removed.

As used herein, the term 'aerosol-forming substrate' denotes a substrate formed from or comprising an aerosol-forming material that is capable of releasing volatile compounds upon heating for generating an aerosol. The aerosol-forming substrate is intended to be heated rather than combusted in order to release the aerosol-forming volatile compounds. Preferably, the aerosol-forming substrate is an aerosol-forming tobacco substrate, that is, a tobacco containing substrate. The aerosol-forming substrate may contain volatile tobacco flavor compounds, which are released from the substrate upon heating. The aerosol-forming substrate may comprise or consist of blended tobacco cut filler or may comprise homogenized tobacco material. Homogenized tobacco material may be formed by agglomerating particulate tobacco. The aerosol-forming substrate may additionally comprise a non-tobacco material, for example homogenized plant-based material other than tobacco.

Preferably, the aerosol-forming substrate may comprise a tobacco web, preferably a crimped web. The tobacco web may comprise tobacco material, fiber particles, a binder material and an aerosol former. Preferably, the tobacco sheet is cast leaf. Cast leaf is a form of reconstituted tobacco that is formed from a slurry including tobacco particles, fiber particles, aerosol former, binder and for example also flavors. Tobacco particles may be of the form of a tobacco dust having particles in the order of 30 micrometers to 250 micrometers, preferably in the order of 30 micrometers to 80 micrometers or 100 micrometers to 250 micrometers, depending on the desired sheet thickness and casting gap. The casting gap influences the thickness of the sheet. Fiber particles may include tobacco stem materials, stalks or other tobacco plant material, and other cellulose-based fibers such as for example wood fibers, preferably wood fibers. Fiber particles may be selected based on the desire to produce a sufficient tensile strength for the cast leaf versus a low inclusion rate, for example, an inclusion rate between approximately 2 percent to 15 percent. Alternatively, fibers, such as vegetable fibers, may be used either with the above fiber particles or in the alternative, including hemp and bamboo. Aerosol formers included in the slurry forming the cast leaf or used in other aerosol-forming tobacco substrates may be chosen based on one or more characteristics. Functionally, the aerosol former provides a mechanism that allows it to be volatilized and convey nicotine or flavoring or both in an aerosol when heated above the specific volatilization temperature of the aerosol former. Different aerosol formers typically vaporize at different temperatures. The aerosol-former may be any suitable known compound or mixture of compounds that, in use, facilitates formation of a stable aerosol. A stable aerosol is substantially resistant to thermal degradation at the operating temperature for heating the aerosol-forming substrate. An aerosol former may be chosen based on its ability, for example, to remain stable at or around room temperature but able to volatize at a higher temperature, for example, between 40 degree Celsius and 450 degree Celsius.

The aerosol former may also have humectant type properties that help maintain a desirable level of moisture in an aerosol-forming substrate when the substrate is composed of a tobacco-based product, particularly including tobacco particles. In particular, some aerosol formers are hygroscopic material that functions as a humectant, that is, a material that helps keep a tobacco substrate containing the humectant moist.

One or more aerosol formers may be combined to take advantage of one or more properties of the combined aerosol formers. For example, triacetin may be combined with glycerin and water to take advantage of the triacetin's ability to convey active components and the humectant properties of the glycerin.

Aerosol formers may be selected from the polyols, glycol ethers, polyol ester, esters, and fatty acids and may comprise one or more of the following compounds: glycerin, erythritol, 1,3-butylene glycol, tetraethylene glycol, triethylene glycol, triethyl citrate, propylene carbonate, ethyl laurate, triacetin, meso-Erythritol, a diacetin mixture, a diethyl sub-erate, triethyl citrate, benzyl benzoate, benzyl phenyl acetate, ethyl vanillate, tributyrin, lauryl acetate, lauric acid, myristic acid, and propylene glycol.

The aerosol-forming substrate may comprise other additives and ingredients, such as flavourants. The aerosol-forming substrate preferably comprises nicotine and at least one aerosol-former. The susceptor being in thermal proximity of or in thermal or physical contact with the aerosol-forming substrate allows for an efficient heating.

A crimped tobacco sheet according to the invention, for example cast leaf, may have a thickness in a range of between about 0.05 millimeter and about 0.5 millimeter, preferably between about 0.08 millimeter and about 0.2 millimeter, and most preferably between about 0.1 millimeter and about 0.15 millimeters.

At least one of the aerosol-forming substrate within the aerosol-forming rod of the article according to the present invention or the aerosol-forming substrate within the aerosol-forming rod resulting from the method according to the present invention or the substrate web comprising an aerosol-forming substrate to be gathered around the susceptor profile according to the method of the present invention may have a density of at least 500 milligram per cubic centimeter, in particular of at least 600 milligram per cubic centimeter or at least 700 milligram per cubic centimeter or at least 800 milligram per cubic centimeter or at least 900 milligram per cubic centimeter or at least 1000 milligram per cubic centimeter or at least 1100 milligram per cubic centimeter. Preferably, that density is at most 2000 milligram per cubic centimeter, in particular at most 1700 milligram per cubic centimeter, preferably at most 1500 milligram per cubic centimeter. As to this, using a susceptor having at least one portion with a reduced cross-section proves particularly advantageous because accurate positioning of the susceptor within the substrate becomes more challenging with increasing density.

The invention will be further described, by way of example only, with reference to the accompanying drawings, in which.

Figure 1:
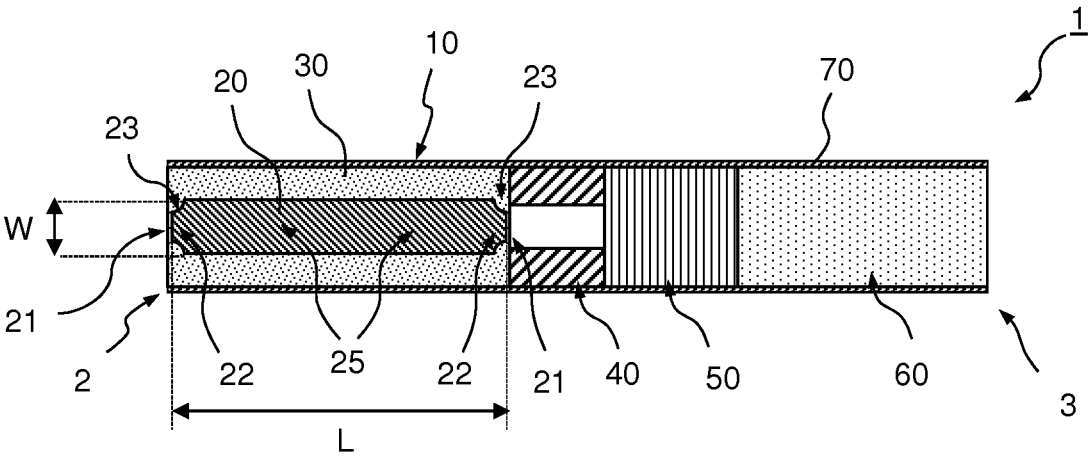
FIG. 1 is a schematic illustration of an inductively heatable aerosol-generating article comprising a susceptor element according to a first exemplary embodiment of the present invention.

FIGS. 9-12 schematically illustrate an exemplary embodiment of the method according to the present invention for manufacturing aerosol-forming rod segments which may be used to form an aerosol-generating article according to FIG. 1; and FIGS. 13-17 schematically illustrate another method for manufacturing aerosol-forming rod segments.

FIG. 1 schematically illustrates a first exemplary embodiment of an inductively heatable aerosol-generating article 1 according to the present invention. The aerosol-generating article 1 substantially has a rod-shape and comprises four elements sequentially arranged in coaxial alignment: an aerosol-forming rod segment 10 comprising a susceptor element 20 and an aerosol-forming substrate 30, a support element 40 having a central air passage, an aerosol-cooling element 50, and a filter element 60 which serves as a mouthpiece. The aerosol-forming rod 10 is arranged at a distal end 2 of the article 1, whereas the filter element 60 is arranged at a distal end 3 of the article 1. Each of these four elements is a substantially cylindrical element, all of them having substantially the same diameter. In addition, the four elements are circumscribed by an outer wrapper 70 such as to keep the four elements together and to maintain the desired circular cross-sectional shape of the rod-like article 1. The wrapper 70 preferably is made of paper. Further details of the article, in particular of the four elements—apart from the specifics of the susceptor element 20 within the rod segment 10—are disclosed in WO 2015/176898 A1.

Figure 2:
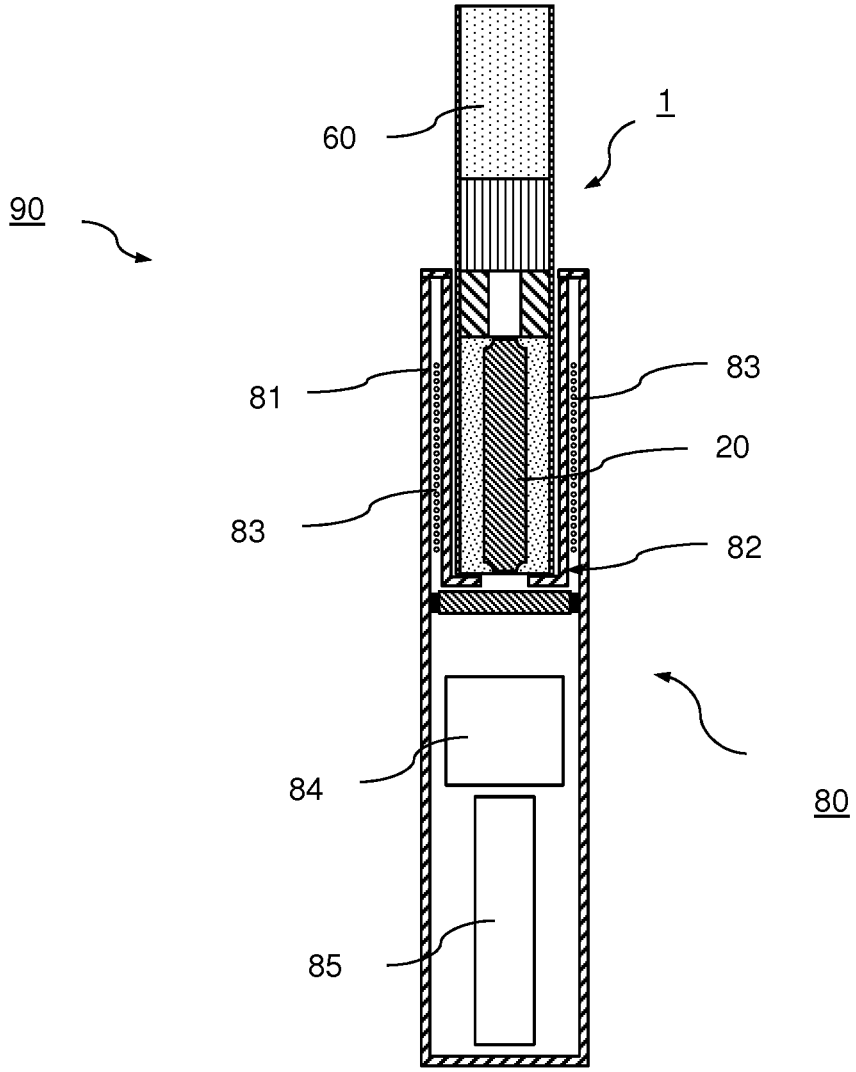
FIG. 2 is a schematic illustration an exemplary embodiment of an aerosol-generating system comprising an aerosol-generating device and the aerosol-generating article according to FIG. 1.

As illustrated in FIG. 2, the aerosol-generating article 1 is configured for use with an inductively heating aerosol-generating device 80. Together, the device 80 and the article 1 form an aerosol-generating system 90. The aerosol-generating device 80 comprises a cylindrical receiving cavity 82 defined within a distal portion of the device housing 81 for receiving a least a distal portion of the article 1 therein. The device 80 further comprises an induction source including an induction coil 83 for generating an alternating, in particular high-frequency electromagnetic field. In the present embodiment, the induction coil 83 is a helical coil circumferentially surrounding the cylindrical receiving cavity 82. The coil 83 is arranged such that the susceptor element 20 of the aerosol-generating article 1 experiences the electromagnetic field upon engaging the article 1 with the device 80. Thus, upon activating the induction source, the susceptor element 20 heats up due to eddy currents and/or hysteresis losses that are induced by the alternating electromagnetic field, depending on the magnetic and electric properties of the susceptor material. The susceptor element 20 heats up until reaching a temperature sufficient to vaporize the aerosol-forming substrate 30 surrounding the susceptor element 20 within the rod segment.

The device 80 further comprises a power supply 85 and a controller 84 (illustrated in FIG. 2 schematically only) for powering and controlling the heating process. Preferably, the induction source is at least partially integral part of the controller 84.

According to the invention, the aerosol-forming rod segment 10 has a cylindrical shape with a constant cross-section, for example a circular cross-section. As mentioned above, the aerosol-forming substrate 30 surrounds the susceptor element 20 such as to define the overall cylindrical shape of the rod segment 10. The elongate susceptor element 20 is located along a central axis of the rod segment 10 and has a length L that is approximately the same as the length of the aerosol-forming substrate 30.

In the present embodiment, the elongate susceptor element 20 is a susceptor strip having a rectangular cross-sectional profile, wherein a thickness extension of the susceptor strip that is smaller a width extension W which in turn is smaller than the length extension L.

The aerosol-forming substrate 30 comprises a gathered sheet of crimped homogenized tobacco material circumscribed by wrapper 70. The crimped sheet of homogenized tobacco material comprises glycerin as an aerosol-former.

According to the invention, the susceptor element 20 comprises at least one narrower portion to improve fixation of the susceptor element 20 within the substrate 30. With regard to the embodiment shown in FIG. 1, the susceptor element 20 comprises a narrower portion 22 at each of its extreme ends 21. That is, the narrower portions 22 comprise a reduced transverse cross-section as compared to one or more portions 25 of the susceptor element 20 along its length extension which comprises a maximum transverse cross-section of the susceptor element. Each of the narrower portions 22 at the extreme ends 21 is formed by two lateral recesses 23 at opposing lateral sides of the elongate susceptor element 20. In the present embodiment, the recesses have a partially circular shape as seen in a longitudinal cross-section through the susceptor element 20 along its length extension. That is, the shape of each recess 23 corresponds to a section of a circle, in particular a quarter of a circle. Due to the edges of the four recesses 23—which advantageously face in both directions along the length extension as well as in opposite directions transverse to the length extension of the susceptor element 20—the surrounding aerosol-forming substrate 30 and the susceptor element 20 interlock such as to significantly improve fixation of the susceptor element 20 within the substrate 30.

FIGS. 3-8 schematically illustrate further exemplary embodiments of the susceptor element 20 which may be alternatively used to form an aerosol-forming rod segment 10 for the aerosol-generating article according to FIG. 1.

Figure 3:
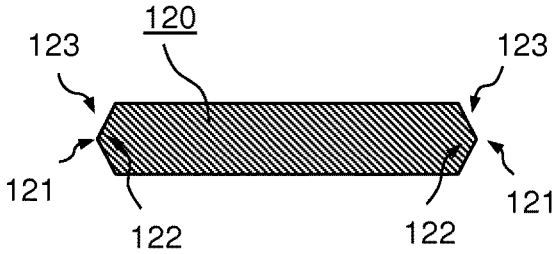
FIGS. 3-8 illustrate further exemplary embodiments of the susceptor element which may be used to form an aerosol-generating article according to FIG. 1.

In FIG. 3, the susceptor element 120 also comprises a narrower portion 122 at each of its extreme ends 121. According to this embodiment, the narrower portion 122 are formed by recesses 123 which have a triangular shape as seen in a longitudinal cross-section through the susceptor element 120 along its length extension. As a result, the extreme ends are conically tapered or pointed. This may be advantageous for inserting the susceptor element into the substrate, as will be described later with regard to the method shown in FIGS. 13-17.

Figure 4:
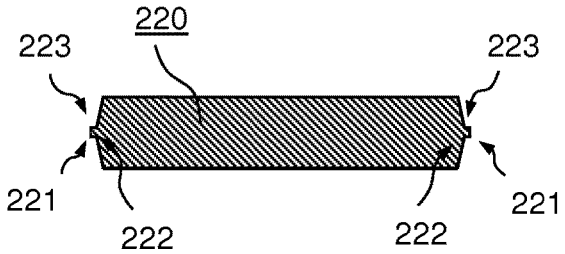

The susceptor element 220 according to FIG. 4 also comprises a narrower portion 222 at each of its extreme ends 221. In the present case, the narrower portions 222 are formed by recesses 223 which have a partially trapezoidal shape as seen in a longitudinal cross-section through the susceptor element 220 along its length extension. Such recesses 223 may result from a method which is described in further detail with regard to FIGS. 9-12.

Figure 5:
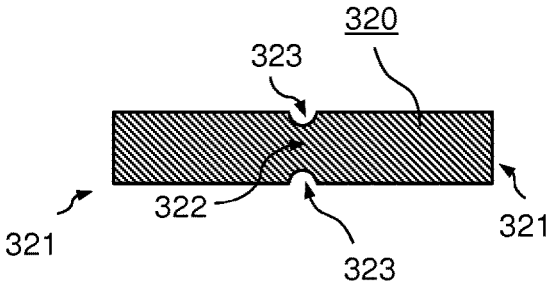

As alternative to a respective narrower portion at each extreme end, the susceptor element 320 according to FIG. 5 comprises a single narrower portion 322 between both of its extreme ends 321. In this embodiment, the narrower portion 322 is formed by two lateral recesses 323 located at opposing lateral sides of the elongate susceptor element 320. The recesses 323 are arranged about midway between both extreme ends 321, at the same longitudinal position with regard to the length extension of the elongate susceptor element 320. The recesses 323 have a semi-circular shape as seen in a longitudinal cross-section through the susceptor element 320 along its length extension. In a similar way as the arrangement of the recesses shown in FIGS. 1, 3 and 4, the semi-circular recesses 323 according to FIG. 4 comprises edges which face in both directions along the length extension as well as in opposite directions transverse to the length extension of the susceptor element 320. Accordingly, this configuration also improves fixation of the susceptor element 320 within the substrate.

Figure 6:
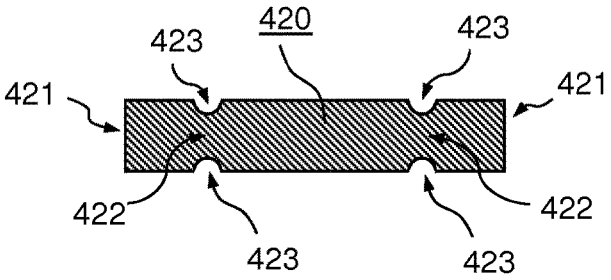

FIG. 6 shows another embodiment of the susceptor element 420 that is similar to the embodiment shown in FIG. 5. Yet, instead of a single narrower portion, the susceptor element 420 according to FIG. 6 comprises two narrower portions 422 between both of its extreme ends 421, each of which is formed by pair of two lateral semi-circular recesses 423 located at opposing lateral sides of the elongate susceptor element 420. The respective two recesses 423 of each pair are arranged at the same longitudinal position with regard to the length extension of the susceptor element 420. Advantageously, this arrangement even further improves fixation of the susceptor element 420 within the substrate which generally increases with an increasing number of recesses.

Figure 7:
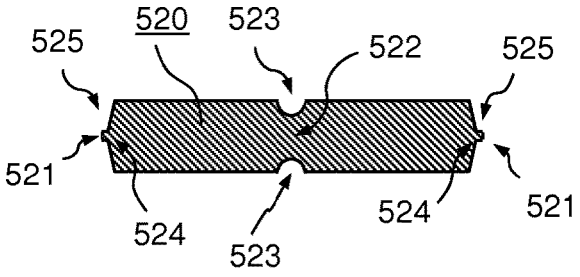

Moreover, as illustrated in FIG. 7, the susceptor element 520 may also comprise narrower portions of different shape. The susceptor element 520 according to embodiment of FIG. 7 comprises a combination of the narrower portions of the embodiments according to FIG. 4 and FIG. 5, that is, a narrower portion 524 at each of extreme end 521 formed by two opposing recesses 525 which have a partially trapezoidal shape, and a single narrower portion 522 between both extreme ends 521 formed by two opposing recesses 523 which have a semi-circular shape.

Figure 8:
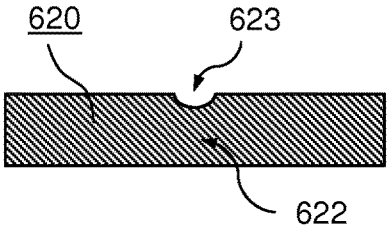
Figure 9:
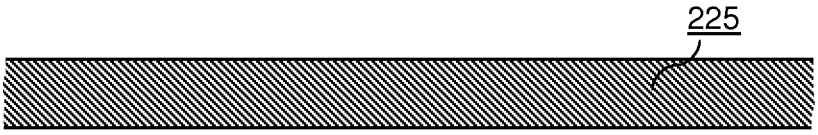
Figure 10:
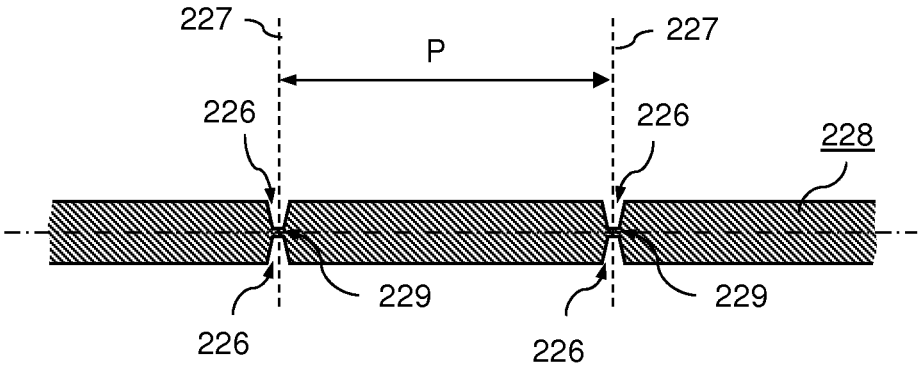
Figure 11:
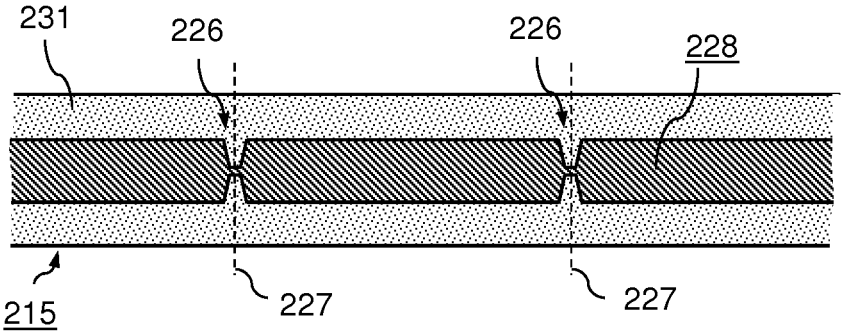
Figure 12:
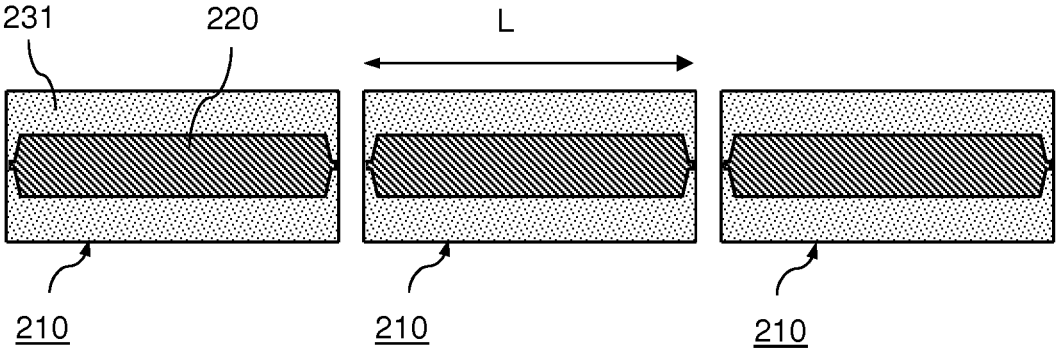
Figure 13:
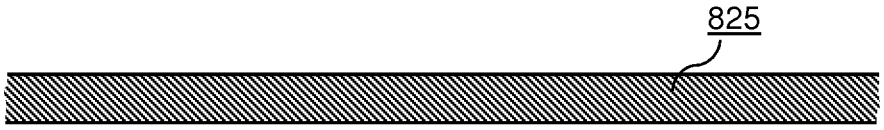
Figure 14:
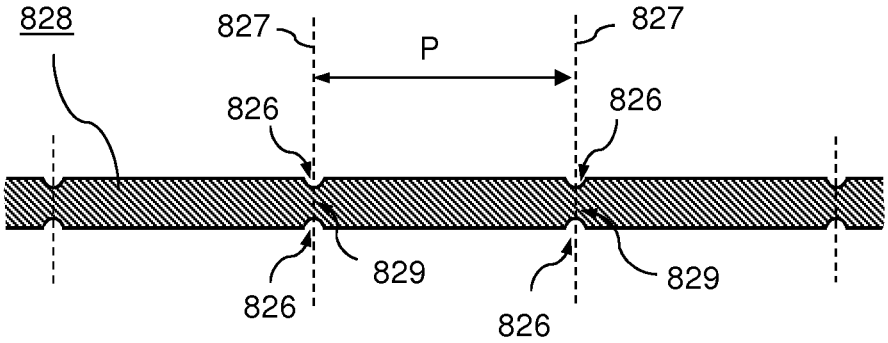
Figure 15:
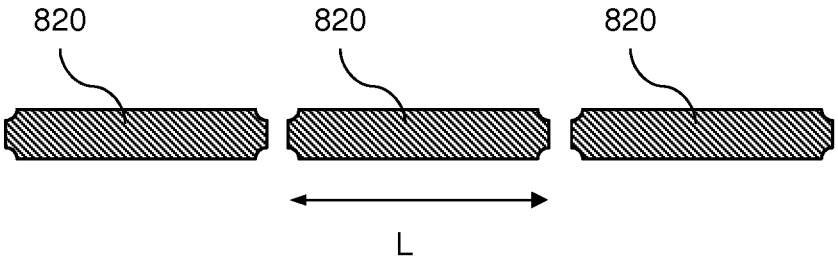
Figure 16:
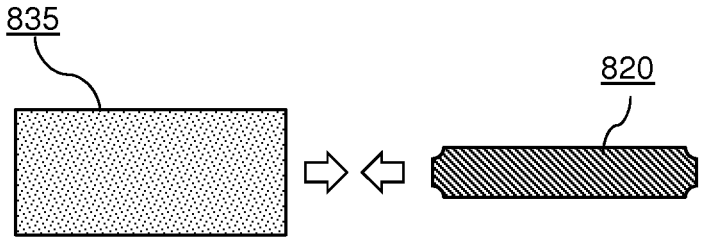

Of course, as illustrated in FIG. 8, it also possible that the susceptor element comprises a narrower portion 622 that is formed by a single recess 623 only. This single recess may be, for example, located at one lateral side of the elongate susceptor element 620. Though this narrower portion is less pronounced as compared to the narrower portions of the susceptor element shown in FIGS. 3-7, it still enables to improve the positional stability of the susceptor element 620 within the substrate.

FIGS. 9-13 schematically illustrate at least partially an exemplary embodiment of the method according to the present invention for manufacturing inductively heatable aerosol-forming rod segments which may be used to form an aerosol-generating article similar or according to FIG. 1. The method basically realizes a continuous rod-forming process which starts by providing a continuous susceptor profile 225 having a constant cross-section, for example, a rectangular cross section (see FIG. 9). In next step, lateral recesses 226 are introduced into the continuous susceptor profile 225 at periodically spaced positions 227 along its length extension such as to generate a continuous susceptor profile 228 comprising periodically spaced narrower portions 229. In the present embodiment, the recesses 226 are introduced at opposing lateral sides of the continuous susceptor 225. The recesses 226 have a substantially trapezoidal shape as seen in a longitudinal cross-section through the susceptor profile 228 along its length extension (see FIG. 10). Parallel to providing the continuous susceptor profile 225 and introducing the lateral recesses 226, a substrate web comprising an aerosol-forming substrate is provided to the continuous rod-forming process (not shown). In a next step, the susceptor profile 228 with the periodically spaced recesses 226 and the substrate web 231 are positioned relative to each other (not shown) followed by gathering the substrate 231 web around the susceptor profile 228 such as to form a continuous rod-shaped strand 215 having a cylindrical shape with a constant cross-section, for example a circular cross-section (see FIG. 11). As to this, the periodically spaced narrower portions 229 cause a reduction of the mechanical stiffness of the susceptor profile 228 which in turn facilitates positioning of the susceptor relative to the substrate web. Finally, the continuous rod-shaped strand 215 is cut at the positions 227 of the narrower portions 229 such as to form individual aerosol-forming rod segments 210 having a length L corresponding to the period length P between the periodically spaced narrower portions 229 (see FIG. 12). Cutting the strand 215, in particular susceptor profile 228 at the narrower portions 229 is much less challenging, in particular requires much less mechanical forces. As a result, the susceptor elements 220 which result from cutting the susceptor profile 228 have an enhanced positional accuracy and stability within the final rod segment 210. At the same, the lifetime of the cutting means used for the cutting process is significantly increased. Moreover, by cutting the strand 215 at the narrower portions 229, the risk of particle migration into the aerosol-forming substrate caused by particle ablation from the susceptor and/or the cutting means is also reduced.

As described above, the rod segments 210 may be used to form an inductively heatable aerosol-generating article, in particular an aerosol-generating article according to the invention and as described herein.

FIGS. 13-17 schematically illustrate an alternative method for manufacturing individual inductively heatable aerosol-forming rod segments which may be used to form an aerosol-generating article according to the invention. The method includes the step of providing a susceptor element according to the invention and as described herein, for example a susceptor element 20 as shown in FIG. 1 and FIG. 2. The step of providing such a susceptor element may also start by providing a continuous susceptor profile 825 having a constant cross-section, for example, a constant rectangular cross section (see FIG. 13). In a next step, lateral recesses 826 are introduced into the continuous susceptor profile 825 at periodically spaced positions 827 along its length extension such as to generate a continuous susceptor profile 828 comprising periodically spaced narrower portions 829. In the present embodiment, the recesses 826 have a substantially semi-circular shape as seen in a longitudinal cross-section through the susceptor profile 828 along its length extension (see FIG. 14). Subsequently, the susceptor profile 828 is cut at the positions of the narrower portions 829 such as to form individual susceptor elements 820 having a length corresponding to the period length P between the periodically spaced narrower portions 829 (see FIG. 15). The susceptor elements 820 resulting from this process corresponds to the susceptor element 20 shown in FIG. 1 and FIG. 2.

Figure 17:
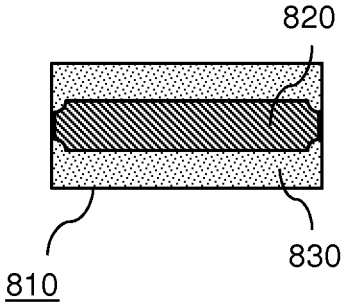

Parallel, prior or after providing the susceptor elements 820, the method comprises the step of providing a substrate rod segment 835 including an aerosol-forming substrate 830: The substrate rod segment 835 has a cylindrical shape with a constant cross-section, and a length that substantially corresponds to the length L of a susceptor element 820. Subsequently, the susceptor element 820 is positioned in the rod segment 835, in particular by moving the susceptor element 820 and the substrate rod segment 835 relative to each other, thereby pushing the susceptor element 820 into the aerosol-forming substrate 830 included in the substrate rod segment 835 (see FIG. 16). The process finally results in an inductively heatable aerosol-forming rod segment 810 as shown in FIG. 17. The rod segment 810 corresponds to the rod segment 10 of the aerosol-generating article shown in FIG. 1 and FIG. 2.

The invention claimed is:

1. An inductively heatable aerosol-generating article for an inductively heating aerosol-generating device, the article comprising:

an aerosol-forming rod segment having a cylindrical shape with a constant outer cross-section including an elongate susceptor element and an aerosol-forming substrate surrounding the elongate susceptor element so as to define the cylindrical shape of the aerosol-forming rod segment, wherein the elongate susceptor element comprises at least one narrower portion at each extreme end of the elongate susceptor element, wherein the narrower portion at each extreme end comprises a reduced transverse cross-section as compared to one or more portions of the elongate susceptor element along a length extension of the elongate susceptor element comprising a maximum transverse cross-section of the elongate susceptor element, wherein the elongate susceptor element further comprises another at least one narrower portion between both extreme ends of the elongate susceptor element, and wherein the another at least one narrower portion between both extreme ends comprises a reduced transverse cross-section as compared to one or more portions of the elongate susceptor element along the length extension of the elongate susceptor comprising the maximum transverse cross-section of the elongate susceptor element.

2. The inductively heatable aerosol-generating article according to claim 1, wherein a minimum cross-sectional dimension of the at least one narrower portion is at most 90% of a maximum cross-sectional dimension of the elongate susceptor element in the one or more portions comprising the maximum transverse cross-section, and wherein the maximum cross-sectional dimension is measured in a same direction as the minimum dimension cross-sectional transverse to the length extension of the elongate susceptor element.

3. The inductively heatable aerosol-generating article according to claim 1, wherein over at least 1% of the length extension of the elongate susceptor element a cross-sectional area of the at least one narrower portion is at most 50% of a cross-sectional area of the maximum transverse cross-section.

4. The inductively heatable aerosol-generating article according to claim 1, wherein over at least 5% of the length extension of the elongate susceptor element a cross-sectional area of the at least one narrower portion is at most 90% of a cross-sectional area of the maximum transverse cross-section.

5. The inductively heatable aerosol-generating article according to claim 1, wherein over at least 80% of the length extension of the elongate susceptor element the reduced transverse cross-section of the at least one narrower portion is at most 80% of a cross-sectional area of the maximum transverse cross-section.

6. The inductively heatable aerosol-generating article according to claim 1, wherein a cross-sectional area of the maximum transverse cross-section is in a range of 0.1 square millimeter to 5.0 square millimeter.

7. The inductively heatable aerosol-generating article according to claim 1, wherein the one or more portions of the elongate susceptor element comprising the maximum transverse cross-section of the elongate susceptor element cover at least 75% of the length extension of the elongate susceptor element.

8. The inductively heatable aerosol-generating article according to claim 1, wherein the elongate susceptor element further comprises at least one lateral recess in the at least one narrower portion at each extreme end of the elongate susceptor element and/or at least one lateral recess in the at least one narrower portion between both extreme ends of the elongate susceptor element.

9. The inductively heatable aerosol-generating article according to claim 1, wherein the elongate susceptor element further comprises at least two lateral recesses at opposing lateral sides of the elongate susceptor element in the at least one narrower portion between both extreme ends of the elongate susceptor element and/or at least two lateral recesses at opposing lateral sides of the elongate susceptor element in the at least one narrower portion at the extreme ends of the elongate susceptor element.

10. The inductively heatable aerosol-generating article according to claim 8, wherein a shape of the at least one lateral recess, as viewed in a longitudinal cross-section through the elongate susceptor element along the length extension, is one of trapezoidal, triangular, wedged, curved, circular, oval, rectangular, or polyhedral.

11. An inductively heatable aerosol-generating article for an inductively heating aerosol-generating device, the article comprising:

an aerosol-forming rod segment having a cylindrical shape with a constant outer cross-section including an elongate susceptor element and an aerosol-forming substrate surrounding the elongate susceptor element so as to define the cylindrical shape of the aerosol-forming rod segment, wherein the elongate susceptor element comprises at least one narrower portion at each extreme end of the elongate susceptor element and/or at least one narrower portion between both extreme ends of the elongate susceptor element, wherein the respective narrower portion comprises a reduced transverse cross-section as compared to one or more portions of the elongate susceptor element along a length extension of the elongate susceptor element comprising a maximum transverse cross-section of the elongate susceptor element, and wherein the one or more portions of the elongate susceptor element comprising the maximum transverse cross-section of the elongate susceptor element cover at least 70% of the length extension of the elongate susceptor element.

12. An inductively heatable aerosol-generating article for an inductively heating aerosol-generating device, the article comprising:

an aerosol-forming rod segment having a cylindrical shape with a constant outer cross-section including an elongate susceptor element and an aerosol-forming substrate surrounding the elongate susceptor element so as to define the cylindrical shape of the rod segment, wherein the elongate susceptor element comprises at least one narrower portion at each extreme end of the elongate susceptor element and/or at least one narrower portion between both extreme ends of the elongate susceptor element, wherein the respective narrower portion comprises a reduced transverse cross-section as compared to one or more portions of the elongate susceptor element along a length extension of the elongate susceptor element comprising a maximum transverse cross-section of the elongate susceptor element, wherein the elongate susceptor element is a susceptor strip, and wherein a width of the susceptor strip is larger than a thickness of the susceptor strip, and the thickness of the susceptor strip in the one or more portions other than the at least one narrower portion is in a range of 0.03 millimeter to 0.15 millimeter.

13. A method for manufacturing inductively heatable aerosol-forming rod segments in a continuous rod-forming process, the method comprising the steps of:

providing a continuous susceptor profile comprising narrower portions having a reduced transverse cross-section at periodically spaced positions along a length extension thereof as compared to one or more portions of the continuous susceptor profile comprising a maximum transverse cross-section of a susceptor element;

providing a substrate web comprising an aerosol-forming substrate;

positioning the susceptor profile and the substrate web relative to each other;

gathering the substrate web around the susceptor profile so as to form a continuous rod-shaped strand having a cylindrical shape with a constant cross-section; and cutting the continuous rod-shaped strand into individual aerosol-forming rod segments having a length equal or larger than a period length between the narrower portions at the periodically spaced positions.

14. The method according to claim 13, wherein the step of providing the continuous susceptor profile comprises the steps of:

providing a continuous susceptor profile having a constant cross-section, and introducing lateral recesses into the susceptor profile at the periodically spaced positions along the length extension so as to generate the continuous susceptor profile comprising the periodically spaced narrower portions.

15. The method according to claim 14, wherein the step of introducing lateral recesses into the susceptor profile includes using a cutting device, and wherein the cutting device comprises at least one of a cutting knife, opposing rollers with cutting knives, a shear, a mil, or a punch.

16. The method according to claim 13, wherein the step of cutting the continuous rod-shaped strand comprises cutting the continuous rod-shaped strand at the positions of the narrower portions so as to form the individual aerosol-forming rod segments having the length corresponding to the period length between the narrower portions at the periodically spaced positions.

17. The method according to claim 13, further comprising the steps of:

tracing a trajectory of the continuous susceptor profile when passing through the continuous rod-forming process;

determining, based on the traced trajectory of the continuous susceptor profile and the period length between the periodically spaced positions of the reduced transverse cross-sections, a point in time when a respective narrower portion of the continuous susceptor profile arrives at a cutting position along the continuous rod-forming process where the step of the cutting the continuous rod-shaped strand into the individual aerosol-forming rod segments takes place; and triggering the step of the cutting the continuous rod-shaped strand at the point in time determined for the respective narrower portion.

* * * * *